US006644202B1

(12) United States Patent
Duniam et al.

(10) Patent No.: US 6,644,202 B1
(45) Date of Patent: Nov. 11, 2003

(54) BLASTING ARRANGEMENT

(75) Inventors: Peter J Duniam, Flemington (AU); Peter J McCallum, The Gap (AU); William H Birney, Niddrie (AU); Rudy W Spiessens, Pretoria (ZA); Vernon West, Pretoria-West (ZA); Vivian E Patz, Johannesburg (ZA)

(73) Assignee: Expert Explosives (Proprietary) Limited, Modderfontein (ZA)

( * ) Notice: Subject to any disclaimer, the term of this patent is extended or adjusted under 35 U.S.C. 154(b) by 0 days.

(21) Appl. No.: 09/762,808

(22) PCT Filed: Aug. 10, 1999

(86) PCT No.: PCT/AU99/00647

§ 371 (c)(1),
(2), (4) Date: Jul. 30, 2001

(87) PCT Pub. No.: WO00/09967

PCT Pub. Date: Feb. 24, 2000

(30) Foreign Application Priority Data

Aug. 13, 1998 (ZA) ..... 98/7268

(51) Int. Cl.[7] ..... F42D 1/055; F42B 3/18

(52) U.S. Cl. ..... 102/312; 102/313; 102/215; 102/217

(58) Field of Search ..... 102/312, 313, 102/215, 217

(56) References Cited

U.S. PATENT DOCUMENTS

| | | | | | |
|---|---|---|---|---|---|
| 3,258,689 | A | | 6/1966 | Ressler | 324/62 |
| 4,324,182 | A | * | 4/1982 | Kirby et al. | 102/217 |
| 4,649,821 | A | | 3/1987 | Marshall | 102/206 |
| 4,674,047 | A | | 6/1987 | Tyler et al. | 364/423 |
| 4,860,653 | A | * | 8/1989 | Abouav | 102/200 |
| 4,869,170 | A | | 9/1989 | Dahmberg | 102/202.5 |
| 4,986,183 | A | * | 1/1991 | Jacob et al. | 102/200 |
| 5,014,622 | A | * | 5/1991 | Jullian | 102/313 X |
| 5,136,949 | A | * | 8/1992 | Grosch | 102/215 |
| 5,214,236 | A | | 5/1993 | Murphy | 102/217 |
| 5,367,957 | A | * | 11/1994 | Hennessey | 102/217 |
| 5,406,890 | A | * | 4/1995 | Marsh et al. | 102/217 |
| 5,520,114 | A | | 5/1996 | Guimard et al. | 102/215 |

(List continued on next page.)

FOREIGN PATENT DOCUMENTS

| | | | | |
|---|---|---|---|---|
| AT | 302136 | | 10/1972 | |
| AU | 59997/86 | | 3/1987 | |
| AU | 38528/95 | | 6/1996 | |
| DE | 35 37 820 | | 4/1987 | |
| EP | 301 848 | | 2/1989 | |
| EP | 0 434 883 | | 7/1991 | |
| EP | 0 588 685 | | 3/1994 | |
| EP | 0 601 831 | | 6/1994 | |
| EP | 0 601 694 | | 7/1994 | |
| FR | 2 593 907 | | 8/1987 | |
| GB | 2093286 | * | 8/1982 | 102/217 |
| WO | WO 00/04337 | | 1/2000 | |

*Primary Examiner*—Peter A. Nelson
(74) *Attorney, Agent, or Firm*—Pillsbury Winthrop LLP

(57) ABSTRACT

A method of and apparatus for use in establishing a blasting arrangement by loading at least one detonator (14) into each of a plurality of blast holes (30), placing explosive material in each blast hole, connecting to a trunk line (10) a control unit (32) that has a power source (52) incapable of firing the detonators, sequentially connecting the detonators, by means of respective branch lines (12), to the trunk line and leaving each detonator connected to the trunk line. In addition the apparatus includes means (46, 50) for receiving and storing in memory means (34, 44) identity data from each detonator, means (46, 50) for generating a signal to test the integrity of the detonator/trunk line connection and the functionality of the detonator, and means (46, 50) for assigning a predetermined time delay to each detonator to be stored in the memory means. The invention also extends to the control unit (32).

20 Claims, 3 Drawing Sheets

U.S. PATENT DOCUMENTS 5,563,366 A * 10/1996 La Mura et al. ..... 102/217
5,621,184 A * 4/1997 Gwynn, III ..... 102/215
5,877,696 A * 3/1999 Powell ..... 340/825.32
5,894,103 A 4/1999 Shann ..... 102/215
5,912,428 A * 6/1999 Patti ..... 102/215
6,014,932 A * 1/2000 Mardirossian ..... 102/200
6,085,659 A 7/2000 Beukes ..... 102/206

* cited by examiner

BLASTING ARRANGEMENT

BACKGROUND OF THE INVENTION

This invention relates to a method of establishing a blasting arrangement, apparatus for use in establishing a blasting arrangement and a blasting method.

The assignation of time delays to individual detonators, used in blasting operation, whether open cut or underground, can be labourious, an aspect which is compounded when use is made of more than one detonator in a blast hole. The integrity of the connection of each detonator to a trunk line must be tested and the functionality of each detonator must be tested. These are time consuming processes which demand close attention to detail and a great deal of care.

The invention is concerned with an improved method of establishing a blasting arrangement.

SUMMARY OF THE INVENTION

In the first instance the invention provides a method of establishing a blasting arrangement which includes the steps of loading a plurality of detonators into a plurality of blast holes with at least one detonator being located in each respective blast hole, placing explosive material in each blast hole, connecting a control unit that has a power source that is incapable of firing the detonators to a trunk line, sequentially connecting the detonators, by means of respective branch lines, to the trunk line and, once each detonator has been so connected to the trunk line, leaving the detonator connected to the trunk line.

The detonators may be connected in any desired sequence to the trunk line.

The method may include the step of recording identity data, pertaining to each respective detonator, in the control unit.

The aforementioned identity data may be recorded in the control unit at the time the respective detonator is connected to the trunk line.

The identity data may be recorded in a predetermined order.

The method may include the step of using the control unit, at the time a detonator is connected to the trunk line, to test the integrity of such connection. The functionality of the connected detonator may also be verified.

Subsequently the method may include the step of testing the integrity and functionality of the array of detonators which have been connected to the trunk line.

The invention may include the step of assigning a time delay period to each respective detonator. The time delay period may be predetermined, for example in accordance with the provisions of an appropriate algorithm, or may be assigned under the control of an operator, to achieve a desired blasting pattern or sequence.

The assigned time delay periods may be displayed graphically, at the time of assignation, on a suitable display. Optionally the time delay interval between time delay periods of adjacent detonators may also be displayed.

The invention may include the step of storing data relating to the detonator identity and the time delay period associated with such a detonator in a memory module which may be detachable from the aforementioned control unit.

According to a variation of the invention the method includes the step of receiving co-ordinate data to identify the physical or geographical location of each detonator and storing such data. The co-ordinate data may be received at least in part from any suitable source such as a global positioning system. The co-ordinate data may include three-dimensional data relating to the position of each detonator and its depth from a reference point. Thus the data may inter alia reflect the position of the blast hole and the depth of the detonator in a blast hole, as opposed to the depth of the blast hole.

In a preferred embodiment the data is represented, at least for display purposes, in a regular pattern which is based on the relative positions of the detonators. Preferably the detonators are represented as being in a two dimensional rectangular array of rows and columns and time delays are assigned to the detonators in a progressive manner working from a starting position in the array to a finishing position.

According to a second aspect of the invention there is provided apparatus for use in establishing a blasting arrangement which includes a trunk line, a plurality of branch lines connected to the trunk line at spaced intervals, and a plurality of detonators which are respectively connected to the branch lines with at least one detonator per branch line, the apparatus including a control unit having memory means, a power source that is incapable of firing the detonators, means for receiving identity data from each detonator as the detonator is connected to the trunk line and for storing the identity data in the memory means, means for generating a signal to test the integrity of the connection of the detonator to the trunk line and the functionality of the detonator, and means for assigning a predetermined time delay to each detonator, the assigned time delay being stored in the memory means together with the identity data of the respective detonator.

The memory means may be detachable from the remainder of the control unit.

The apparatus may include display means for displaying at least the time delay which is assigned to each detonator.

The time delay assigning means may include means for incrementing one or more preset time periods, in a controllable manner, to assign a predetermined time delay to each detonator.

The invention also provides a blasting method which includes the steps of sequentially connecting a plurality of detonators by means of respective branch lines to a trunk line, at the time of connecting each detonator using a control unit which is connected to the trunk line to verify, at least, the integrity of each connection and the functionality of the respective detonator, receiving data, transmitted from each respective detonator, pertaining to its identity, assigning a respective predetermined time delay period to each detonator, storing the identity data of each detonator and its assigned time delay period in a memory module, disconnecting the control unit from the trunk line, connecting a firing unit to the trunk line, powering energy storage means at each respective detonator by means of the firing unit, transferring to each detonator its respective assigned time delay period, and using the firing unit to initiate the firing of the detonators.

The invention may, by way of example, also extend to a control unit which includes a barcode scanner for obtaining identity data from a readable bar code corresponding to the identity number of the detonator provided that in use of the detonator, the bar code protrudes from the blast hole in which the detonator is located or is otherwise positioned so that the bar code is readable.

In a variation of the aforementioned technique use may be made of a passive transponder in respect of each detonator.

The passive transponder may be incorporated in the electronic circuit which is used, within the detonator, to control the delay period and to monitor safety features. The transponder is interrogated by means of a suitable signal and, once interrogated, transmits a signal which contains the identity data and which is received by a receiver which automatically extracts the identity number. The identity data can then be transferred directly to a memory module without human intervention.

The invention also provides a control unit for use in a blasting system which includes a plurality of detonators, the control unit including memory means for storing at least one time interval, means for adjusting the time interval, means for displaying a time delay period, means for varying the displayed time delay period at least by steps with each step corresponding to the stored time interval, thereby to achieve a desired time delay period, and means for associating the desired time delay period with a selected detonator.

The memory means may store a plurality of different time intervals.

Each of the stored time intervals may be independently adjustable. The stored time intervals may be increments or decrements.

The stored time interval may be adjusted to correspond to the time delay between detonators of adjacent blast holes. Alternatively, where the detonators have been connected by means of branch lines, the stored time intervals may be adjusted to correspond to the time delay between adjacent branch lines.

BRIEF DESCRIPTION OF THE DRAWINGS

The invention is further described by way of examples with reference to the accompanying drawings in which.

DESCRIPTION OF PREFERRED EMBODIMENTS

Figure 1:
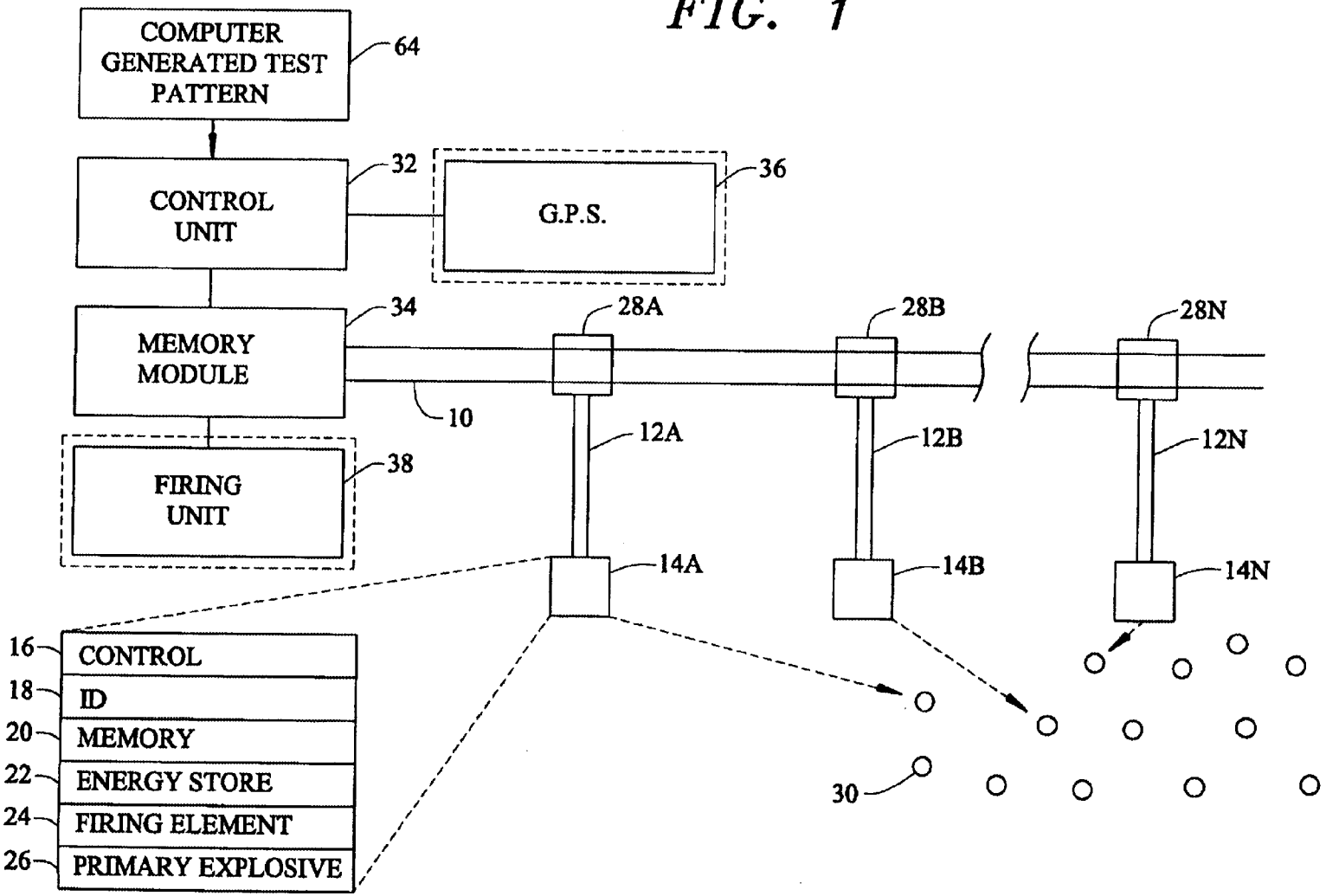
FIG. 1 is a schematic illustration of a blasting arrangement according to the invention.

FIG. 1 of the accompanying drawings illustrates a blasting arrangement which includes a trunk line 10 to which are connected a plurality of branch lines 12A, 12B . . . 12N at spaced intervals. Each branch line terminates in a detonator 14 which is located in a blast hole, not shown. The detonator is of a known construction and for example is of the kind described in the specification of South African patent No. 87/3453. A detonator of this kind includes a control module 16, a storage device 18 for storing identity data pertaining to the detonator, a memory unit 20, an energy storage device 22 such as a capacitor, and a detonator firing element 24 e.g. a fusible link, to which is applied a primary explosive 26.

Use is made of a plurality of connectors 28A, 28B . . . 28N, of known construction, for effecting the connection of each representative branch line to the trunk line 10.

Each detonator is located in a respective blast hole 30 which is one of a plurality of blast holes notionally arranged, for ease of reference, in a matrix form in rows and columns. According to requirement and the prevailing conditions more than one detonator may be located in a blast hole. Thereafter explosive material is placed in the blast hole.

The blasting arrangement is established making use of a control unit 32 and a memory module 34. Optionally use may be made of a global positioning system 36. Firing of the detonators is achieved under the control of a firing unit 38.

Figure 2:
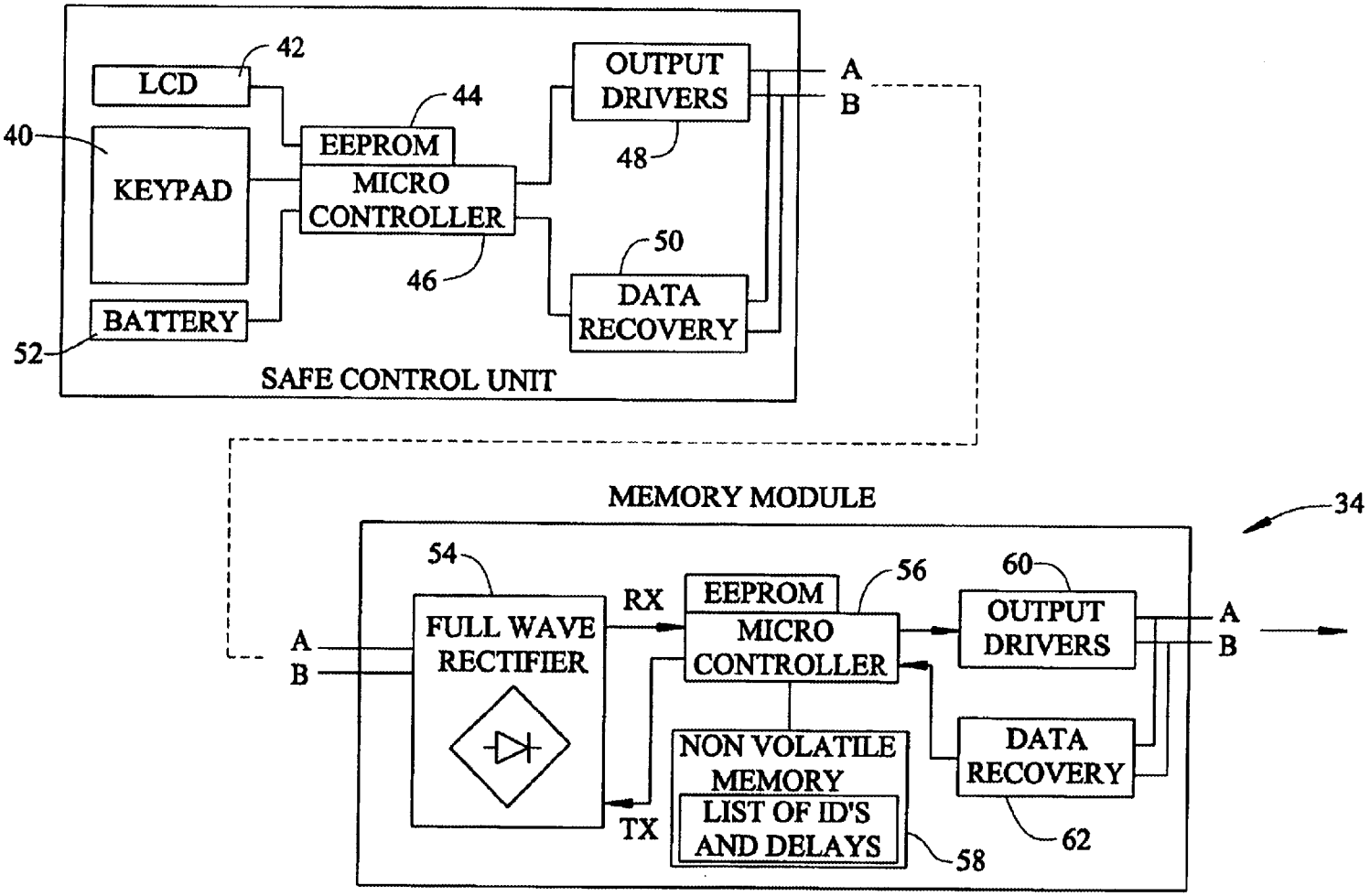
FIG. 2 is a block diagram representation of a control unit and memory module used in establishing the blasting arrangement of FIG. 1.

The control unit and the memory module are shown in block diagram form in FIG. 2. The control unit includes a keypad 40, a liquid crystal display 42, a memory unit 44, a microprocessor 46, output drivers 48 and a data receiver and extraction module 50. The control unit is powered by means of an onboard battery 52 which has a fully charged voltage which is incapable of firing any of the detonators 14. In addition it should be stressed that the control module 16 in each detonator possesses multiple safety features designed to avoid accidental initiation of the firing element 24 in the detonator.

The memory module 34 includes a power supply 54 which powers a microprocessor 56 and a non-volatile memory 58. The module also includes output drivers 60 and a data receiver 62.

Data from the global positioning system 36 may be input to the control unit 32, as an optional feature. The data pertains to the geographical position of each respective detonator and, where applicable, its depth below surface i.e. its depth in the particular borehole. A desired, previously derived, blasting pattern generated by means of a computer 64, in which delays are correlated with positional data, may be input to the control unit which then uses the corresponding positional data to assign the appropriate time delays to the respective detonators, using the detonator identities as the link.

The firing unit 38 is not described herein for its operation is substantially conventional. The firing unit is capable of charging the capacitor 22 in each detonator to a voltage which is sufficiently high to initiate the respective firing element when a suitable fire signal is generated by the firing unit.

Initially the control unit 32 and the memory module 34 are connected to the trunk line 10 which leads from blast hole to blast hole at a potential blast site. Each detonator, which is attached to its respective branch line, is connected to the trunk line using an appropriate connector 28. The detonators are connected in any desired sequence although, generally, connection will take place, at least in a rectangular array, in successive rows or columns in the array.

The memory unit 44 in the control unit 32 contains the facility for storing a plurality of adjustable time delay periods. Each time delay period may be varied, according to requirement, by inputting data at the keypad 40. Further it is possible to treat each time delay period as an increment or a decrement. The display 42 provides details on each time delay period to a user of the control unit.

When a detonator is connected to the trunk line the voltage which is impressed on the trunk line from the control unit is not greater than the voltage of the battery 52. The control module 16 ensures that the voltage is, in any event, not applied to the capacitor 22. The integrity of the connection effected by means of the connector 28 is verified by sending a suitable signal from the microprocessor 46 to the detonator and by receiving a signal which is returned by the detonator on the trunk line. The return signal is extracted by means of the data recovery device 50 and verified by the microprocessor 46. The functionality of the detonator is, in this way, also verified.

The signal which is returned from the detonator contains data pertaining to the identity of the detonator extracted from the unit 18. This identity data is displayed on the display 42. The geographical position of the detonator is also known for example from a blast plan which is prepared beforehand. Alternatively geographical data pertaining to the location of the detonator is extracted from a suitable source such as the global positioning system 36 referred to hereinbefore. The depth of each detonator in its respective blast hole is also measured in any appropriate way and the depth data is also transferred to the control unit.

The keypad 40 is manipulated, according to requirement, using a stored time delay period from the memory unit 44, to generate a predetermined or desired time delay period which is then assigned to the detonator in question. The time delay period and the detonator identity are transferred to the memory module 34 and stored in the non-volatile memory 58.

The aforementioned process is repeated each time a detonator is connected to the trunk line. Thus the identity of the detonator is established and a time delay period is assigned to the detonator in accordance with its identity and its geographical position. All the identity data and time delay periods are stored in the memory module 34.

The memory module 34 is detachable from the control unit 32. Once the module has been disconnected from the control unit it is possible to connect the memory module to the firing unit 38. Firing of the detonators can then take place at any chosen time.

When it is desired to fire the detonators the firing unit 38 is used to charge each capacitor 22 to an operative voltage level. All of the capacitors in the various detonators are in fact charged to the same voltage level. Thereafter the memory module 34 is initiated so that the time delay period associated with each respective detonator is transferred through the output driver 60 to the respective detonator. This matching process is accomplished by means of the associated stored identity data pertaining to the respective detonator. The time delay period for each detonator is stored in the associated memory unit 20. Once all the time delay data have been transferred to the various detonators the firing sequence can be commenced. A control signal is sent by the firing unit to each detonator which then commences a count-down through the respective stored time delay period and, once the time delay period has elapsed, the energy stored in the capacitor 22 is used to initiate the firing element 24. This in turn initiates the primary explosive 26 and the explosive which is located in the blast hole is then fired.

The blasting arrangement makes use of the control unit 32 which, as has been noted, has a battery voltage which is incapable of firing the various detonators, to allow sequential connection of the detonators to the trunk line under powered conditions. In this way the integrity of each connection and the functionality of each detonator can be verified at the time of connection. All relevant data pertaining to the position, identity and time delay period of each detonator are stored in the module 34. The control unit and the module 34 are not capable of initiating the firing of any detonator. This can only take place under the control of the firing unit 38 and it is not possible to connect the firing unit to the blasting system unless the control unit has been disconnected.

Figure 3:
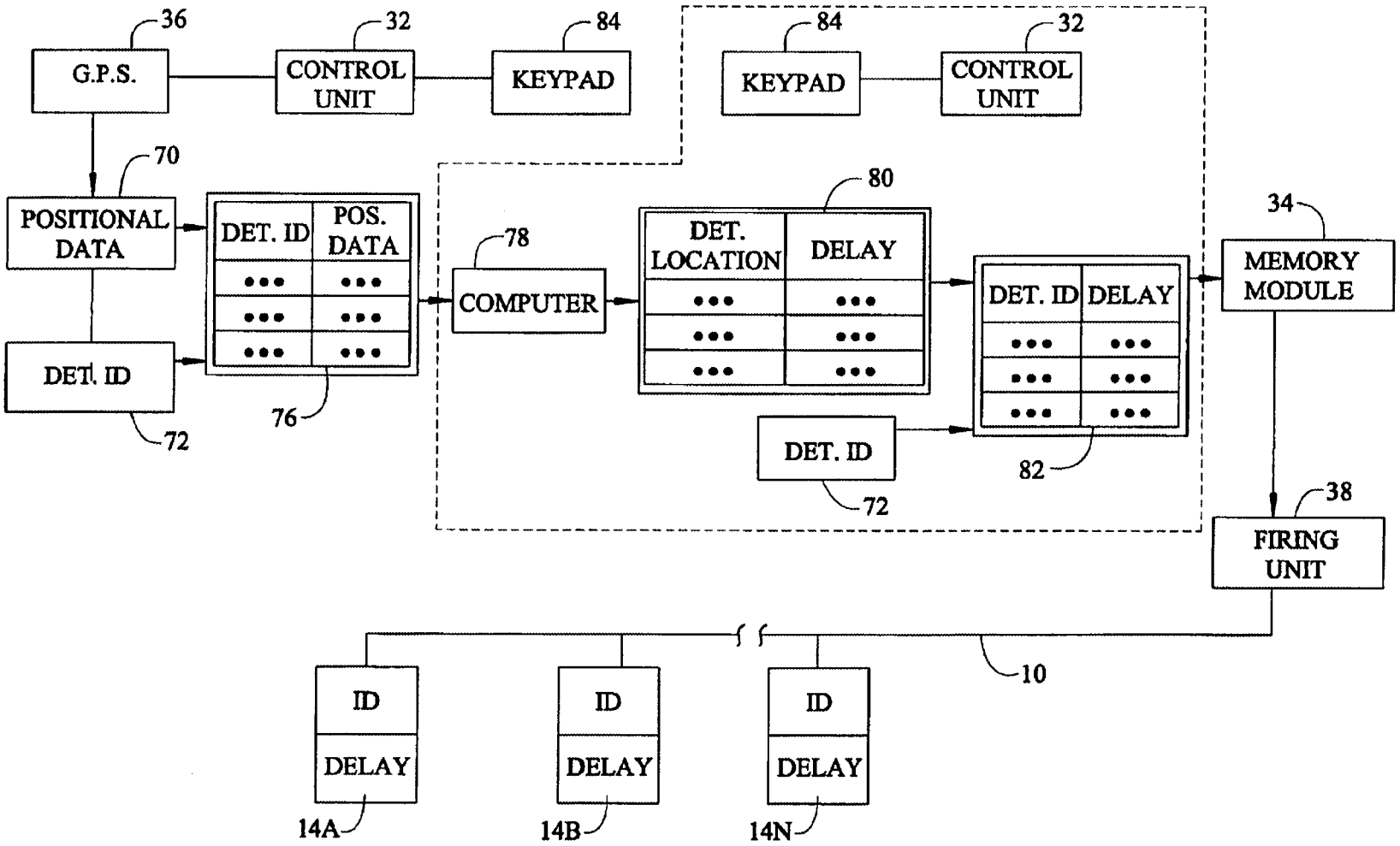
FIG. 3 is a representation of different steps in establishing a blasting arrangement.

FIG. 3 shows different steps in establishing a blasting arrangement. Thus positional data 70 obtained from any suitable source, for example a digital global positioning system 36, and relating to the position of each detonator, is correlated with the identity data 72 of the detonators, to establish a correlated table 76 which is stored in the control unit 32. The detonator identity data 72 is also stored in the memory module 34.

The table 76 is uploaded to a computer 78 running design software in which the positional data is represented in a three dimensional array. One or more design algorithms embodying blast design rules are implemented to calculate time delay periods which are required for the individual detonators in order to achieve a desired blast pattern. The delay periods are then assigned to the respective detonators using the geographical or positional data 70 as a link.

The linked data 80 is transferred to the control unit 32 to establish a table 82 of detonator identities and associated time delays in the control unit.

When the control unit is connected to the memory module 34 the detonator identities are matched and the time delays are allocated to the detonator identities in the memory module.

Use may then be made of firing unit 38 to assign the respective delay periods to the programmable detonators 14 in the various blast holes, and to fire the detonators 14 in the desired temporal sequence.

The control unit 32 can take on a number of different forms which may depend on the particular application.

As has been noted, the assignation of delays to blast holes using programmable detonators is labourious as the optimal delays may be odd numbers. Generally the delays are assigned to the blast hole array with constant time delays along rows and constant (different) delays between rows.

The control unit is designed such that these optimised delays are achieved with minimal effort through the calibration of increment and decrement keys provided on the keypad 84.

Delays between holes are relative to each other and relative to the zero initiation time. The control unit displays the absolute time which is then changeable by an optimised increment or decrement as connection progresses along or between rows.

The control unit has an automatic increment, again calibrated by the user, to enable standard incremental delays to be allocated to detonators without changing the primary absolute delay. The automatic increment corresponds to the constant time delays along rows or the constant (different) time delays between rows. This has the advantage of obviating the need for the user to calculate such delays manually. This is effective where there are a plurality of detonators in a single blast hole.

Where complex algorithms are used to generate delay timing to blast holes the resulting delay sequencing may be difficult to assign to detonators as the delay intervals may be non-constant to a large extent. The use of this embodiment of the invention generates a list of identity numbers and corresponding time delay periods which are automatically built up and stored in the memory module 34, as the detonators 14 are connected to the trunk line 10.

In an alternative embodiment of the invention, the control unit is designed to remove the requirement for the operator to assign delays manually.

Where there is a substantial period between the planning and drilling of the blast hole arrangements and their priming with detonators the blast plan may be captured on the computer 78 running appropriate software. Placement of detonators and allocation of appropriate delays can be determined before loading the holes with detonators.

The graphical position of each hole is then identified in a meaningful manner relevant to on-bench operators. Such information may take the form:

Row number, Hole Number, Detonator position in the hole, position within a deck within a hole, etc.

A number of blasts may be designed and downloaded. The information is stored thus:

| BLASTNAME (unique identifier of a particular blast design) | |
|---|---|
| Det Location Information | Delay |

This information is downloaded to the control unit.

On powering up the control unit the user selects the blast by selecting the blastname. The control unit then displays the Det Location Information and Delay in a list that may be accessed by using scrolling keys on the keypad 86.

The operator displays the Det Location Information of a particular detonator on the control unit display, goes to that detonator on the blast array, and connects the detonator to the trunk line. The delay for that position from the control unit and the detonator identity from the detonator are then written into a table 82 and then into the memory module 34.

Thus the delay has been associated with the detonator identity by the operator matching positional information from the table 80 to the real space position of the detonator.

As each detonator is connected the relative specific position in the control unit download list is flagged to indicate that the detonator has been allocated the requisite delay.

After connection the detonator identity and time delay information stored in the memory module are used for blasting.

The table in the control unit may be uploaded to the computer 78 running design software and displayed graphically by matching the unique blastname identifier. This allows the designer to inspect the implementation of the connection, noting what has been connected, errors, missing detonators and incomplete hookups, etc. The design may then be edited and re-downloaded.

Where use is made of a positioning system 36 then, on connection of a detonator, the detonator identity is written into memory of the memory module 34 and the control unit 32. Positional information is also written into the control unit memory.

When connection is completed the control unit is attached to a computer 78 running design software and the detonator identity and the positional data table is uploaded and displayed graphically based on the positional information.

Delay design algorithms then allocate delays based on the locations of the detonators in space, the locations of voids, free faces, vibration, fragmentation requirements, etc. The optimally designed delay information is then written to a table comprising detonator identity, positional data and time delay periods. This table is then downloaded to a control device which may be a control unit or blaster or any other suitable device. The control device then assigns the calculated delays to the detonator identity information stored in the memory module at the time of connection.

Principal advantages are that hookup is totally independent of delay allocation, and the integration of automatic positional information with delay design.

What is claimed is:

1. A method of establishing a blasting arrangement which includes the steps of loading a plurality of individually identifiable detonators into a plurality of blast holes with at least one detonator being located in each respective blast hole, placing explosive material in each blast hole, connecting a control unit that has a power source that is incapable of firing the detonators to a trunk line, sequentially connecting the detonators, by means of respective branch lines, to the trunk line and, once each detonator has been so connected to the trunk line, leaving the detonator connected to the trunk line, recording identity data pertaining to each detonator in the control unit at the time the respective detonator is connected to the trunk line, and utilising the control unit to assign a respective time delay period for each detonator.

2. A method according to claim 1 which includes the step of receiving co-ordinate data to identify the physical or geographical location of each detonator and storing such data.

3. A method according to claim 2 wherein the co-ordinate data is received at least in part from a global positioning system.

4. A method according to claim 1 which includes the step of using the control unit, at the time a detonator is connected to the trunk line, to test the integrity of such connection.

5. A method according to claim 1 which includes the step of using the control unit, at the time a detonator is connected to the trunk line, to test the functionality of the connected detonator.

6. A method according to claim 1 which includes the step of testing the integrity and functionality of the array of detonators which have been connected to the trunk line.

7. A method according to claim 2 wherein the co-ordinate data includes three dimensional data relating to the position of each detonator and its depth from a reference point.

8. A method according to claim 1 wherein the time delay period is determined in accordance with the provisions of an appropriate algorithm, or is assigned under the control of an operator, to achieve a desired blasting pattern or sequence.

9. A method according to claim 1 wherein each assigned time delay period is displayed graphically, at the time of assignation, on a suitable display.

10. A method according to claim 1 wherein the time delay interval between time delay periods of adjacent detonators is displayed graphically.

11. A method according to claim 9 or 10 wherein the data is represented, at least for display purposes, in a regular pattern which is based on the relative positions of the detonators.

12. A method according to claim 11 wherein the detonators are represented as being in a two dimensional rectangular array of rows and columns and time delays are assigned to the detonators in a progressive manner working from a starting position in the array to a finishing position.

13. A method according to claim 1 which includes the step of storing data relating to the identity of each detonator and the assigned time delay period associated with such detonator in a memory module which is detachable from the control unit.

14. A control unit for use in a blasting system which includes a plurality of individually identifiable detonators, the control unit having a power source that is incapable of firing the detonators and further including memory means for storing at least one time interval, means for adjusting the time interval, means for displaying a time delay period, means for varying the displayed time delay period at least by steps with each step corresponding to the stored time interval, thereby to achieve a desired time delay period, and means for associating the desired time delay period with a selected detonator wherein the control unit is capable of receiving identity data from each detonator and of storing the identity data and the respective time delay period associated with each of the plurality of detonators in the memory means for subsequent transfer to the detonators.

15. A control unit according to claim 14 wherein the memory means stores a plurality of the said different time intervals.

16. A control unit according to claim 14 wherein each of the stored time intervals is independently adjustable.

17. Apparatus for use in establishing a blasting arrangement which includes a trunk line, a plurality of branch lines connected to the trunk line at spaced intervals, and a plurality of individually identifiable detonators which are respectively connected to the branch lines with at least one detonator per branch line, the apparatus including a control unit having memory means, a power source that is incapable of firing the detonators, means for receiving identity data from each detonator as the detonator is connected to the trunk line and for storing the identity data in the memory means, means for generating a signal to test the integrity of the connection of the detonator to the trunk line and the functionality of the detonator, and means for assigning a predetermined time delay to each detonator, the assigned time delay being stored in the memory means together with the identity data of the respective detonator.

18. Apparatus according to claim 17 wherein the control unit includes a bar code scanner for obtaining identity data from a readable bar code.

19. Apparatus according to claim 17 which includes means for interrogating a passive transponder which contains the identity number of a detonator and which is carried by or fixed to the detonator.

20. A control unit according to claim 15 wherein the stored time intervals are adjustable to correspond to the time delay between detonators of adjacent blast holes or to correspond to the time delay between adjacent branch lines.

* * * * *